1/24/84 OR 4,427,067

United States Patent [19]

Stone

[11] 4,427,067

[45] Jan. 24, 1984

[54] WATER AND MISCIBLE FLUID FLOODING METHOD HAVING GOOD VERTICAL CONFORMANCE FOR RECOVERING OIL

[75] Inventor: Herbert L. Stone, Houston, Tex.

[73] Assignee: Exxon Production Research Co., Houston, Tex.

[21] Appl. No.: 405,833

[22] Filed: Aug. 6, 1982

[51] Int. Cl.[3] ..... E21B 43/16; E21B 43/30

[52] U.S. Cl. ..... 166/274; 166/245

[58] Field of Search ..... 166/245, 268, 273, 274

[56] References Cited

U.S. PATENT DOCUMENTS

| | | | |
|---|---|---|---|
| 2,623,596 | 12/1952 | Whorton et al. | 166/268 |
| 2,968,350 | 1/1961 | Slobod et al. | 166/273 |
| 3,065,790 | 11/1962 | Holm | 166/9 |
| 3,084,743 | 4/1963 | West et al. | 166/9 |
| 3,208,517 | 9/1965 | Binder, Jr. et al. | 166/274 |
| 3,319,712 | 5/1967 | O'Brien | 166/2 |
| 3,346,046 | 10/1967 | Boston | 166/274 |
| 3,472,320 | 10/1969 | Dyes | 166/273 |
| 3,565,175 | 2/1971 | Wilson | 166/269 |
| 3,586,107 | 6/1971 | Parrish | 166/273 |
| 3,661,208 | 5/1972 | Scott et al. | 166/274 |
| 4,034,810 | 7/1977 | Holloway | 166/274 |
| 4,042,029 | 8/1977 | Offeringa | 166/272 |
| 4,085,797 | 4/1978 | Trantham et al. | 166/245 |
| 4,086,961 | 5/1978 | Braden, Jr. et al. | 166/245 |
| 4,113,011 | 9/1978 | Bernard et al. | 166/273 |
| 4,261,420 | 4/1981 | Hitzman | 166/246 |
| 4,265,310 | 5/1981 | Britton et al. | 166/259 |
| 4,303,126 | 12/1981 | Blevins | 166/245 |
| 4,375,238 | 3/1983 | Parsons | 166/274 |

FOREIGN PATENT DOCUMENTS

| | | | |
|---|---|---|---|
| 664186 | 6/1963 | Canada | 166/274 |
| 788784 | 7/1968 | Canada | 166/274 |
| 1029842 | 1/1965 | United Kingdom | 166/274 |

OTHER PUBLICATIONS

"Vertical Conformance in an Alternating Water-Miscible Gas Flood" by Stone, SPE, 1982.

"The Pembina Miscible Displacement Pilot and Analysis of Its Performance" by Justen et al., Petroleum Transactions, AIME.

"Scaled-Model Experiments Show How $CO_2$ Might Economically Recover Residual Oil" by Doscher et al., Oil and Gas Journal, Apr. 12, 1982.

"Oil Recovery by Carbon Dioxide" by Dept. Petr. Eng., U.S.C., European Symposium on Enhanced Oil Recovery, Sep. 21-23, 1981.

*Primary Examiner*—Ernest R. Purser
*Assistant Examiner*—William P. Neuder
*Attorney, Agent, or Firm*—Karen T. Burleson

[57] ABSTRACT

A method for recovering oil from a subterranean formation by alternately injecting water and fluid miscible with the oil into the formation to displace the oil is disclosed. In this method, the wells are spaced sufficiently close together, and the water and miscible fluid are injected at a rate, such that a value between 0.3 and 1.5 is obtained for a dimensionless parameter. This parameter is a ratio of viscous flow forces to gravity forces. It is equal to the total injection rate of the water and miscible fluid divided by the product of the density difference between the miscible fluid and the water, the average vertical permeability of the reservoir, the area of the reservoir to be flooded by an injection well, and the sum of the mobilities of the miscible fluid and the water at steady state around the injection well.

10 Claims, 2 Drawing Figures

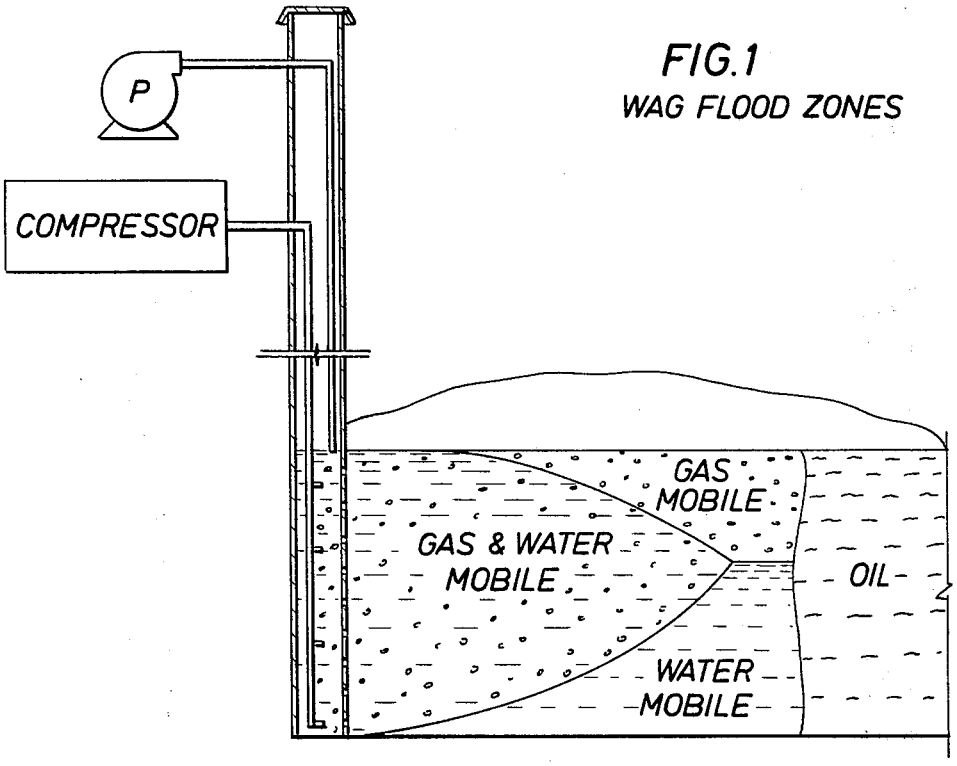
FIG.1
WAG FLOOD ZONES
FIG. 2 OIL RECOVERY VS. VISCOUS-GRAVITY RATIO FOR A HOMOGENEOUS AND A HETEROGENEOUS RESERVOIR
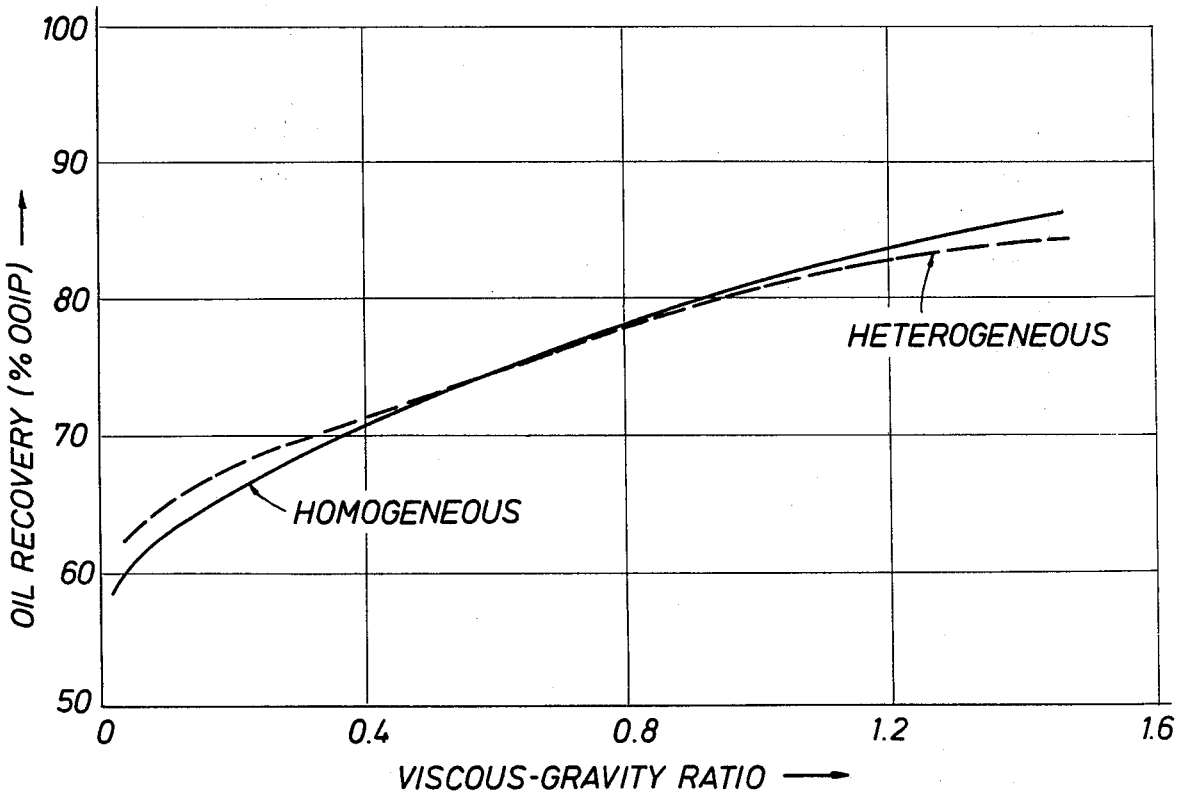

WATER AND MISCIBLE FLUID FLOODING METHOD HAVING GOOD VERTICAL CONFORMANCE FOR RECOVERING OIL

BACKGROUND OF THE INVENTION

This invention relates to a method for recovering oil by alternately injecting water and fluid miscible with the oil into an oil reservoir to displace the oil.

BRIEF DESCRIPTION OF THE PRIOR ART

It became recognized around the mid-1950's that gas miscible with oil in a subterranean reservoir could be used to displace to oil. Such displacement was soon found to be inefficient, however, because of the low viscosity of the gas relative to the oil. The gas fingered through the oil, giving poor conformance and resulting in a low recovery of the oil. Injecting water along with the gas was proposed to control this fingering and poor conformance. The water decreased the mobility of the gas by lowering the relative permeability of the reservoir to the gas. Field tests showed it was most feasible to inject the water alternately with the gas. This process became known as "WAG flooding". This term is now also applied when any miscible fluid is used, not just gas.

Oil recovery by WAG flooding has been limited by gravity segregation of the gas and water. Gravity segregation, not limited to WAG floowing, occurs in all flooding processes. Gravity segregation in a typical waterflood is described in U.S. Pat. No. 3,565,175 to Wilson, issued Feb. 23, 1971. In a WAG flood, gravity causes the gas to rise to the top of the reservoir and water to migrate to the bottom. A miscible flood occurs in a thin layer at the top of the reservoir. The remainder of the reservoir is only waterflooded.

Various methods have been proposed to control or reduce gravity segregation in WAG floods and various other water and miscible flooding methods. For example, Wilson describes a method for reducing gravity segregation of an aqueous flooding fluid in a reservoir containing fluids of a lower density than the aqueous flooding fluid. That method calls for adjusting the viscosity of the aqueous flooding fluid injected into progressively lower levels of the reservoir. This is said to decrease the mobility of the fluid sufficiently to offset the additional pressure exerted at the lower levels by the higher density aqueous flooding fluid. The pressures are more equal at all levels tending to improve conformance. Another example is U.S. Pat. No. 3,661,208 to Scott et al, issued May 9, 1972. That patent describes a method for controlling gravity segregation in a miscible gas flood process by maintaining the reservoir at such a pressure that the miscible fluid has a density essentially the same as that of the reservoir oil.

However, gravity segregation has remained a problem in WAG flooding. The various methods proposed to control or reduce gravity segregation are often not economically feasible: they are expensive processes in themselves and/or they do not result in enough oil recovery to make them profitable. Other such methods are successful only in certain types of reservoirs or under certain reservoir conditions. Usually such methods, while appropriate for waterfloods or miscible slug drives, are not useful for improving the vertical conformance of a WAG flood.

SUMMARY OF THE INVENTION

This invention relates to a method for recovering oil by injecting water and fluid miscible with the oil into a subterranean reservoir to displace the oil. A recovery zone is defined by a plurality of wells drilled into the reservoir in communication for injection and production. The wells are spaced sufficiently close together, and the water and miscible fluid are injected at a rate, such that a value between 0.3 and 1.5 is obtained for a dimensionless parameter. This critical parameter is equal to the total injection rate of both the water and miscible fluid injected into the injection well divided by the product of the density difference between the miscible fluid and the water, the average vertical permeability of the reservoir, the horizontal area of the reservoir to be flooded by the injection well, and the sum of the mobilities of the miscible fluid and the water at steady state around the injection well.

BRIEF DESCRIPTION OF THE DRAWINGS

FIG. 1 illustrates three steady state zone in a reservoir that result from gravity segregation in a WAG flood.

FIG. 2 is a plot of the percentage of oil recovered from a reservoir from a WAG flood and the viscous gravity ratio for the flood for a homogeneous reservoir and for a heterogeneous reservoir, both of which have the same average permeability.

DESCRIPTION OF THE PREFERRED EMBODIMENT

The present invention is premised on the fact that gravity segregation in a WAG flood requires some time to occur. In the region immediately adjacent to the wellbore, the injected water and miscible fluid (usually a gas) flow together. As gravity causes the miscible fluid to migrate toward the top and the water toward the bottom of the reservoir, three zones develop, as shown in FIG. 1. Miscible fluid is in the top zone where only the miscible fluid is mobile, water is in the bottom zone where only water is mobile, and miscible fluid and water flowing simultaneously are in the middle zone. As the water and miscible fluid progress through the reservoir over time, the middle zone becomes smaller while the top and bottom zones become larger. When the top and bottom zones meet, gravity segregation is complete, resulting in generally unsuitable oil recovery downstream from this point.

Since both the simultaneous flow zone and the top zone are flooded by the miscible fluid, the residual oil saturation in both regions following the WAG flood will be near zero. Only the bottom zone will retain an appreciable residual oil saturation, the waterflood residual. The average recovery for the reservoir flooded may be estimated by calculating the total volume occupied by each zone. The average oil recovery for the reservoir equals the sum for all three zones of the product of the fractional volume of each zone times the recovery from that zone.

In this invention, the wells penetrating the reservoir to be flooded are preferably spaced so that the area required for complete gravity segregation is approximately equal to the horizontal area to be flooded. Hence gravity segregation is preferably not complete until the injection fluids reach a producing well. Such completion occurs when a critical dimensionless parameter is approximately equal to one. This parameter is a ratio of viscous flow forces to gravity forces and will be referred to herein as the "viscous-gravity ratio." This ratio is expressed as follows (the units need only be consistent, e.g. all MKS values, etc.):

$$\frac{I_t}{(\Delta\rho)(k_v)(a)\left(\frac{k_{rw}}{\mu_w}+\frac{k_{rs}}{\mu_s}\right)}$$

where, $I_t$ is the total injection rate of both the water and the miscible fluid injection into the well;

$\Delta\rho$ is the difference in density between the water and the miscible fluid;

$k_v$ is the average vertical permeability of the reservoir;

a is the horizontal area of the reservoir to be flooded by the injection well; and $$\left(\frac{k_{rw}}{\mu_w}+\frac{k_{rs}}{\mu_s}\right)$$

is the sum of the mobilities of the water and the miscible fluid at steady state around the injection well.

The horizontal area of the reservoir to be flooded by the injection well is simply determined from the distance between the injection and production wells. Horizontal area, and not volume, may be used because the zone in the middle of the formation will exist until the miscible fluid and water zones meet each other. When they meet, gravity segregation will be complete. This, then, is the limit for proper injection rate and well spacing.

High recovery (for example, greater than 65%) of oil from a reservoir WAG flood is realized when the viscous-gravity ratio has a value between 0.3 and 1.5. For a selected value of the viscous-gravity ratio, the injection rate for the water and miscible fluid and the well spacing may be adjusted as appropriate for the particular characteristics of the reservoir. Similarly, the range of values for the viscous-gravity ratio for which good recovery may be obtained with a WAG flood allows flexibility in the injection rates and well spacing for economic reasons as well as for adapting the process to the particular characteristics of the reservoir.

The physical characteristics of a reservoir are of significance to this invention primarily in the manner in which they influence injection rate and well spacing. Reservoir thickness is one such factor. A relatively thick reservoir (ex. 200 feet deep) will allow high injection rates. This will permit sparse well spacing for a viscous-gravity ratio of approximately one. A relatively thin reservoir (ex. 10 feet deep), on the other hand, will have a low maximum injection well rate. Hence, dense well spacing will be required to achieve high recovery of oil. Such dense well spacing may not be economical. A low fracture gradient is similarly unfavorable as it limits the pressure which can be used for injection without initiating fractures and hence limits the injection rate. Fracturing is undesirable in a WAG flood and is to be avoided because it causes channels in the reservoir which increase the rate of gravity segregation.

Reservoir permeability is another factor influencing injection rate and well spacing. A low horizontal permeability limits the maximum injection rate. This effect is offset, however, by the appearance of the vertical permeability in the denominator of the viscous-gravity ratio. Hence, it is the ratio of horizontal to vertical permeability which limits the value of the viscous-gravity ratio, and not the permeability level.

The permeability distribution is of some significance in a heterogeneous reservoir. Simulation studies indicated that an impermeable shale streak located mid-height in a reservoir decreases oil recovery from this invention by 5% of the original oil in place ("OOIP") when compared to oil recovery from the same reservoir (under the same simulation conditions) without the shale layer. The explanation for this decrease is that the shale halves the vertical distances involved while the rate of gravity segregation remains unchanged, so that the time required for complete segregation decreases by a factor of two. A permeable mid-height shale streak, however, actually increases recovery 15% (OOIP) when compared to the same reservoir without the shale layer under the same simulation conditions. This increase is explained by a finger of miscible gas forming just below the shale, soon reaching the producing well, and continually feeding gas into the layer above the shale completely flooding that layer. When this flooding is combined with the normal sweep of the lower zone, increased recovery results.

Simulations of a reservoir with two equally thick homogeneous layers, one layer being more permeable than the other, were compared to simulations of a homogeneous reservoir having the same permeability as the average permeablity of the two layer reservoir. Recovery is 5% (OOIP) lower for the case in which the more permeable layer is at the top of the reservoir and 8% (OOIP) higher for the case in which the more permeable layer is at the bottom. This is explained by the gas preferentially entering the more permeable layer when it is on top and poorly sweeping the less permeable bottom layer. When the more permeable layer is on the bottom, the gas fingers along the top of that layer similar to its behavior with the permeable shale streak.

A multi-layer reservoir was also studied by simulation. The permeabilities of its layers are shown in Table I. It had a high permeability layer at its mid-height. A homogeneous reservoir with the same arithmetic average permeability was studied for comparison. FIG. 2 depicts the oil recovery from each of these two simulated reservoirs for a range of values for the viscous-gravity ratio. The recovery curves are very nearly the same, indicating that a high permeability zone near the middle of a reservoir will not have a pronounced effect on oil recovery by WAG flooding.

TABLE I

PERMEABILITY DISTRIBUTION FOR MULTI-LAYER HETEROGENEOUS RESERVOIR SIMULATION

| LAYER | KX md | KY md |
|---|---|---|
| 1 | 185 | |
| | | 98 |
| 2 | 211 | |
| | | 115 |
| 3 | 246 | |
| | | 154 |
| 4 | 370 | |
| | | 216 |
| 5 | 494 | |
| | | 256 |
| 6 | 526 | |
| | | 270 |
| 7 | 555 | |
| | | 270 |

TABLE I-continued

PERMEABILITY DISTRIBUTION FOR MULTI-LAYER HETEROGENEOUS RESERVOIR SIMULATION

| LAYER | KX md | KY md |
|---|---|---|
| 8 | 526 | |
| | | 256 |
| 9 | 494 | |
| | | 216 |
| 10 | 370 | |
| | | 154 |
| 11 | 246 | |
| | | 115 |
| 12 | 211 | |
| | | 98 |
| 13 | 185 | |
| ARITHMETIC AVERAGE | 370.0 | |

The simulated reservoirs discussed above were 1320 feet long, 240 feet high, and 1320 feet wide. They had a porosity of 18.3%. The water had a density of 62.4 lbs/cf and a viscosity of 0.400 cp. The miscible gas had a density of 14.0 lbs/cf or 38.18 lbs/cf and a viscosity of 0.05 cp. The oil had a density of 45.0 lbs/cf and a viscosity of 0.750 cp. The vertical and horizontal dispersion coefficient was $3.4\times10^{-5}$ $cm^2$/sec. Initial operating conditions included a pressure of 3,000 psia, 25% water saturation and 75% oil saturation. Both injection and production wells were completed throughout the reservoir thickness. Injection of oil and gas was simultaneous for expediency. This was justified at least for the reservoir descriptions and conditions simulated in the study, because simulation showed that there was little difference in results as long as injection cycles were kept below 1 to 2 months.

Permeability and reservoir heterogeneity, then, while of some significance, do not dominate the percent of oil recovered using this invention. They will explain in part, however, why a simulation of this invention and its actual performance in the field may vary to some degree. Such variance, however, is generally expected in comparing simulations to actual field behavior.

This invention is applicable equally to a virgin reservoir and to a reservoir that has been previously waterflooded or gas flooded or a combination thereof. Except in a virgin reservoir, wells will already have been drilled in the reservoir. These wells may be taken into account in considering the well spacing determined from the viscous-gravity ratio. For economic reasons, it may be undesirable to drill additional wells, or in the case of a virgin reservoir, it may be economically desirable to drill as few wells as necessary.

The number of wells needed for the WAG flood may be minimized by effectively planning the flood pattern or drive. For example, consider a rectangular reservoir, 8.49 miles long, 2.83 miles wide, and 240 feet thick, with a well spacing of 80 acres per well. This field could be divided into 24 patterns of 640 acres each, with each pattern containing 8 wells. Three of these wells would lie on the pattern boundary and 5 would be interior wells. The boundary wells would be producers; the interior wells would be injectors, but only one at a time. Well 1 would be used for injection for the first one-fifth of the project life, Well 2 for the second one-fifth, etc. Each injection well would need to flood only one-fifth of the 640 acre pattern or 128 acres. This is a realistic plan for this reservoir, for which the viscosity-gravity ratio is 0.5 and the injection rate is limited to 22,000 RB/D per well. A conventional nine-spot pattern would require 40 wells in this 640 acre area, rather than 8 wells, to achieve the same viscous-gravity ratio and the same oil recovery.

A rolling line drive is another approach for spacing the wells and planning the WAG flood under this invention. Line drive processes are well known in the art, one example being described in U.S. Pat. No. 4,085,797 to Trantham et al, issued Apr. 25, 1978. The reservoir discussed in the pattern flood above could, for example, be divided in an array of $8\times24$ eight-acre blocks, each containing one well. Twenty-four injection wells on one side of the field would be used to initiate the flood at injection rates of 22,000 RB/D per well. After the twenty-four 80-acre blocks were flooded out, injection would be shifted to the second line of 24 wells and so on down the field. The resulting viscous-gravity ratio would be 0.8.

Economics may also influence the miscible fluid chosen for the flood and how much of the miscible fluid is available for the flood. Near-miscible fluids may be substituted in this invention for miscible fluids, generally without drastically reducing the amount of oil recovered. Often, an example of such a fluid which could be used is methane mixed with propane and butane. The amount of miscible fluid available at the site may also be limited. The water/gas ratio is not critical in the range 1 to 4. lower values have the advantages of a shorter project life, and a more limited produced volume of injected fluids or gas. Higher values, however, may result in a lower rich gas volume requirement, which may offset the disadvantages of a longer project life and greater produced volumes of injected fluids or gas. Dry gas or fluid immiscible with the oil, but miscible with the fluid which is miscible with the oil, may also be substituted for oil-miscible fluid after injection is more than half completed or after a bank of the miscible fluid has been injected of sufficient thickness or size that it is not easily penetrated by the dry gas or immiscible fluid.

Miscible fluid may also be stretched by only injecting it into a fraction of the patterns, for example, one-half of the patterns. If needed, water can be injected at any desired rate into the remaining half of the patterns, since a prior waterflood does not affect ultimate WAG flood recovery. This may be the preferred approach to maintain well productivity, or to control sweep patterns around a well. The remaining fraction of the patterns may be injected with miscible fluid after the first fraction is completely flooded which will probably be a number of years later. This flooding a segment of a reservoir at a high injection rate and then switching the flood to another segment results in greater vertical conformance and hence higher recovery than occurs with flooding all patterns simultaneously at the same rate.

As for the actual mechanics of the WAG flood injection, it is generally most economical for the water and miscible fluid injections to be made alternately from the same wellbore. Another approach, however, is to multiply complete the well (with one completion for injection of the water and another completion for injection of the miscible fluid). This approach is more economical than for injection to be made from separate wells (one well for injection of the water and one well for injection of the miscible fluid). Simultaneous injection of water and miscible fluid from the same wellbore completion can also be done. In fact, simultaneous injection of the water and miscible fluid into the reservoir (either from different completions of the wellbore or from different wells) may be substituted for alternate injection in this invention.

The various miscible fluids which may be used in this process, as well as the mechanics of injection (i.e., pumps, meters, etc.), will be known to those skilled in the art. Suitable miscible fluids often include intermediate molecular weight hydrocarbons such as propane and butane. Also, mobility control additives, such as polymers, may be present in the water.

The principle of the invention and the best mode contemplated for applying that principle have been described. It is to be understood that the foregoing is illustrative only and that other means and techniques can be employed without departing from the true scope of the invention defined in the following claims.

I claim:

1. A method of recovering oil from a subterranean oil reservoir by injection of water and fluid miscible with said oil comprising:

(a) drilling a plurality of wells in communication for injection and production, defining a recovery zone within the reservoir, while spacing said wells sufficiently close and then injecting said water with said miscible fluid in said wells for injection at sufficient rate such that a value between 0.3 and 1.5 is obtained over said recovery zone for the following dimensionless parameter:

$$\frac{I_t}{(\Delta\rho)(k_v)(a)\left(\frac{k_{rw}}{\mu_w}+\frac{k_{rs}}{\mu_s}\right)},$$

where, $I_t$ is the total injection rate of both the water and the miscible fluid injected into an injection well, $\Delta\rho$ is the difference in density between the water and the miscible fluid, $k_v$ is the average vertical permeability of the reservoir, a is the horizontal area of the reservoir to be flooded by the injection well, and $$\left(\frac{k_{rw}}{\mu_w}+\frac{k_{rs}}{\mu_s}\right)$$

is the sum of the mobilities of the water and the miscible fluid at steady state around the injection well;

(b) producing said oil from said reservoir from said production wells.

2. The method of claim 1 wherein said injection rate is below that which would fracture said reservoir.

3. The method of claim 1 wherein said recovery zone is at one end of said reservoir and said wells are drilled in lines, the farthest line being used for injection and the second farthest line being used for production, said farthest line being shut in and said second farthest line being drilled for production, defining a second recovery zone, when recovery from first said recovery zone has been completed, said method being repeated until the opposite end of said reservoir has been reached.

4. The method of claim 1 where near miscible fluid is used in place of said misible fluid.

5. The method of claim 1 further comprising injecting a fluid immiscible with said oil, but miscible with said miscible fluid, after injecting said miscible fluid into said reservoir.

6. The method of claim 1 wherein water and miscible fluid are alternately injected.

7. The method of claim 1 wherein water and miscible fluid are simultaneously injected.

8. The method of claim 1 where said miscible fluid is a gas.

9. A method of recovering oil from a subterranean oil reservoir by alternate injection of water and fluid miscible with said oil, said reservoir being penetrated by a plurality of wells for injection and production, comprising:

(a) defining a pattern of wells for injection of said water and miscible fluid and production of said oil wherein the spacing of the wells in said pattern and the rate of injection of said water and miscible fluid is such that a value between 0.3 and 1.5 is obtained for the following dimensionless parameter for any given injection well in said pattern:

$$\frac{I_t}{(\Delta\rho)(k_v)(a)\left(\frac{k_{rw}}{\mu_w}+\frac{k_{rs}}{\mu_s}\right)}$$

where, $I_t$ is the total injection rate of both the water and the miscible fluid injected into said given injection well, $\Delta\rho$ is the difference in density between the water and the miscible fluid, $K_v$ is the average vertical permeability of the reservoir, a is the area of the reservoir to be flooded by said given injection well, and $$\left(\frac{k_{rw}}{\mu_w}+\frac{k_{rs}}{\mu_s}\right)$$

is the sum of the mobilities of the water and the miscible fluid at steady state around said given injection well;

(b) alternately injecting said water and said miscible fluid in said injection wells in said pattern of wells and producing from the production wells in said pattern of wells to recover oil.

10. The method of claim 9 wherein said plurality of wells are in rows and said pattern of wells is for a rolling line drive.

* * * * *

UNITED STATES PATENT AND TRADEMARK OFFICE

CERTIFICATE OF CORRECTION

PATENT NO. : 4,427,067

DATED : January 24, 1984

INVENTOR(S) : Herbert L. Stone

It is certified that error appears in the above—identified patent and that said Letters Patent is hereby corrected as shown below:

In Column 6: the phrase "eight-acre" in line 9 should read -- eighty acre --; and the word "lower" in line 26 should read -- Lower --.

Signed and Sealed this

*Fourth* Day of *September 1984*

[SEAL]

*Attest:*

GERALD J. MOSSINGHOFF

*Attesting Officer*

*Commissioner of Patents and Trademarks*